US007904001B2

(12) United States Patent
Tateyama et al.

(10) Patent No.: US 7,904,001 B2
(45) Date of Patent: Mar. 8, 2011

(54) DEVELOPING UNIT, PROCESS CARTRIDGE, AND IMAGE FORMING APPARATUS HAVING A PLURALITY OF CONVEYOR MEMBERS, A SUPPLY PART, AND A DISCHARGE PART

(75) Inventors: Susumu Tateyama, Tokyo (JP); Yoshitaka Fujinuma, Tokyo (JP); Masayoshi Nakayama, Tokyo (JP); Tatsuya Kubo, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 525 days.

(21) Appl. No.: 12/027,636

(22) Filed: Feb. 7, 2008

(65) Prior Publication Data

US 2008/0199223 A1 Aug. 21, 2008

(30) Foreign Application Priority Data

Feb. 16, 2007 (JP) ..... 2007-036928

(51) Int. Cl.
*G03G 15/08* (2006.01)

(52) U.S. Cl. ..... 399/254; 399/260

(58) Field of Classification Search ..... 399/254, 399/256, 257, 259, 260, 263
See application file for complete search history.

(56) References Cited

U.S. PATENT DOCUMENTS

| | | | | |
|---|---|---|---|---|
| 2006/0210318 | A1 * | 9/2006 | Murata et al. | 399/257 |
| 2007/0025773 | A1 * | 2/2007 | Tateyama et al. | 399/254 |
| 2007/0274742 | A1 | 11/2007 | Nakayama et al. | |
| 2007/0280744 | A1 | 12/2007 | Kubo et al. | |

FOREIGN PATENT DOCUMENTS

| | | | |
|---|---|---|---|
| JP | 6-308829 | | 11/1994 |
| JP | 7-199639 | | 8/1995 |
| JP | 11-133710 | | 5/1999 |
| JP | 2000112238 | A * | 4/2000 |
| JP | 2000-315016 | | 11/2000 |
| JP | 2001-183893 | | 7/2001 |
| JP | 2001-249545 | | 9/2001 |
| JP | 2005-128043 | | 5/2005 |
| JP | 2006323238 | A * | 11/2006 |

OTHER PUBLICATIONS

Machine English translation of JP2000112238.*
Machine English Translation of JP2006323238.*
U.S. Appl. No. 12/060,606, filed Apr. 1, 2008, Nakayama, et al.

* cited by examiner

*Primary Examiner* — David M Gray
*Assistant Examiner* — Billy J Lactaoen
(74) *Attorney, Agent, or Firm* — Oblon, Spivak, McClelland, Maier & Neustadt, L.L.P.

(57) ABSTRACT

A developing unit containing developer including carrier and toner and developing a latent image formed on an image carrier is disclosed. The developing unit includes multiple conveyor members configured to convey the contained developer in respective longitudinal directions so as to form a circulation channel; a supply part configured to supplement the carrier in the developing unit; a discharge part configured to discharge a first part of the contained developer outside the developing unit; and a bypass channel configured to cause a second part of the developer to return to the upstream side of the circulation channel without passing a position where the discharge part is provided.

21 Claims, 7 Drawing Sheets

DEVELOPING UNIT, PROCESS CARTRIDGE, AND IMAGE FORMING APPARATUS HAVING A PLURALITY OF CONVEYOR MEMBERS, A SUPPLY PART, AND A DISCHARGE PART

BACKGROUND OF THE INVENTION

1. Field of the Invention

The present invention relates generally to image forming apparatuses using electrophotography, such as copiers, printers, facsimile machines, and multifunction machines having two or more of their functions, and developing units and process cartridges provided therein, and more particularly to a developing unit of the trickle development system, which suitably supplies new carrier into the developing unit, and a process cartridge and image forming apparatus including the same.

2. Description of the Related Art

There is a conventionally known technique that suitably supplies new carrier to a developing unit containing two-component developer formed of toner and carrier (in some cases, with an additive added thereto) in image forming apparatuses such as copiers and printers, which technique is referred to as the trickle development system. (See, for example, Japanese Laid-Open Patent Application No. 2001-183893.)

Toner is suitably supplied into the developing unit using a two-component developer through a toner supply opening provided in part of the developing unit in accordance with toner consumption in the developing unit. The supplied toner and the developer in the developing unit are agitated and mixed using a conveying member (an agitating member) such as a screw conveyor. Part of the agitated and mixed developer is supplied to a developing roller. The developer carried on the developing roller is restricted to an appropriate amount by a doctor blade. Thereafter, toner in the two-component developer adheres to a latent image on a photosensitive body drum at a position opposite the photosensitive body drum.

Thus, the carrier in the two-component developer contained in the developing unit remains in the developing unit without being consumed in a regular development process. Therefore, the carrier is degraded over time. In detail, the "film scraping phenomenon," where the electrostatic charge capability of a carrier is reduced by the abrasion or separation of its coating layer due to lengthy agitation and mixing of the carrier in the developing unit, or the "spent phenomenon," where the electrostatic charge capability of a carrier is reduced by adhesion of a toner component or additive to the surface of the carrier, occurs.

The trickle development system prevents degradation of the quality of an output image due to such carrier degradation over time. That is, this system maintains the amount and electrostatic charge capability of carrier contained in the developing unit by reducing a degraded portion of the carrier in the developing unit by suitably supplying new carrier (or new two-component developer) into the developing unit and suitably discharging part of the two-component developer contained in the developing unit from the developing unit.

Image forming apparatuses using this trickle development system achieve stabilization of the quality of an output image even over time compared with those requiring replacement of a developing unit or carrier with a new one every time there is degradation of the carrier with time.

Japanese Laid-Open Patent Application No. 2001-183893 describes a developing unit using the trickle development system, where overflow-type discharge means is employed for discharging a developer from the developing unit. In detail, a discharge opening (hole) is provided in the developing unit, and the developer (a portion made surplus by the supply of carrier) is discharged outside from the discharge opening when the surface of the developer conveyed to the position of the discharge opening exceeds a predetermined height.

According to the above-described developing unit of the trickle development system of Japanese Laid-Open Patent Application No. 2001-183893, when driving of the unit is started, the developer in the unit may be inclined to locally cause great undulations on its surface, so that there may be an unintended discharge of the developer. Repeated occurrence of such a phenomenon at every start and stop of the driving of the unit may cause an excessive discharge of the developer in the developing unit, thus causing a shortage of the amount of the developer.

This shortage of the amount of the developer in the developing unit causes the degraded condition of the developer to be unstable or the amount of electrostatic charge of toner to be reduced, thus causing a problem on an output image, such as a decrease in image density.

SUMMARY OF THE INVENTION

Embodiments of the present invention may solve or reduce one or more of the above-described problems.

According to one or more embodiments of the present invention, there are provided a developing unit, a process cartridge, and an image forming apparatus in which one or more of the above-described problems may be solved or reduced.

According to one or more embodiments of the present invention, there are provided a developing unit of the trickle development system where even if developer in the developing unit is inclined in an undulatory manner, no variation is caused in the amount of the developer discharged outside and the quality of an output image is stabilized, and a process cartridge and an image forming apparatus including the same.

According to one embodiment of the present invention, there is provided a developing unit containing a developer including a carrier and a toner, and developing a latent image formed on an image carrier, the developing unit including a plurality of conveyor members configured to convey the contained developer in respective longitudinal directions so as to form a circulation channel; a supply part configured to supplement the carrier in the developing unit; a discharge part configured to discharge a first part of the contained developer outside the developing unit; and a bypass channel configured to cause a second part of the developer to return to an upstream side of the circulation channel without passing a position where the discharge part is provided.

According to one embodiment of the present invention, there is provided a developing unit containing a developer including a carrier and a toner, and developing a latent image formed on an image carrier, the developing unit including a plurality of conveyor members configured to convey the contained developer in respective longitudinal directions so as to form a circulation channel; a supply part configured to supplement the carrier in the developing unit; a discharge part configured to discharge a part of the contained developer outside the developing unit; and a projection part configured to control entrance of the developer into the discharge part, the projection part being provided at one of an upper end and a lower end of the discharge part.

According to one embodiment of the present invention, there is provided a process cartridge removably provided in a main body of an image forming apparatus, the process cartridge including the developing unit and the image carrier as set forth in any of the above-described developing units, the developing unit and the image carrier being integrated as a unit.

According to one embodiment of the present invention, there is provided an image forming apparatus including the developing unit and the image carrier as set forth in any of the above-described developing units.

According to one or more embodiments of the present invention, since there is provided a bypass channel for causing part of the developer to return to the upstream side of a circulation channel without passing a position where a discharge part is provided, it is possible to provide a developing unit of the trickle development system according to which no variation is caused in the amount of the developer discharged outside so that the quality of an output image is stabilized even if there is an undulatory inclination in the developer in the developing unit 23; and a process cartridge and an image forming apparatus including the developing unit.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1:
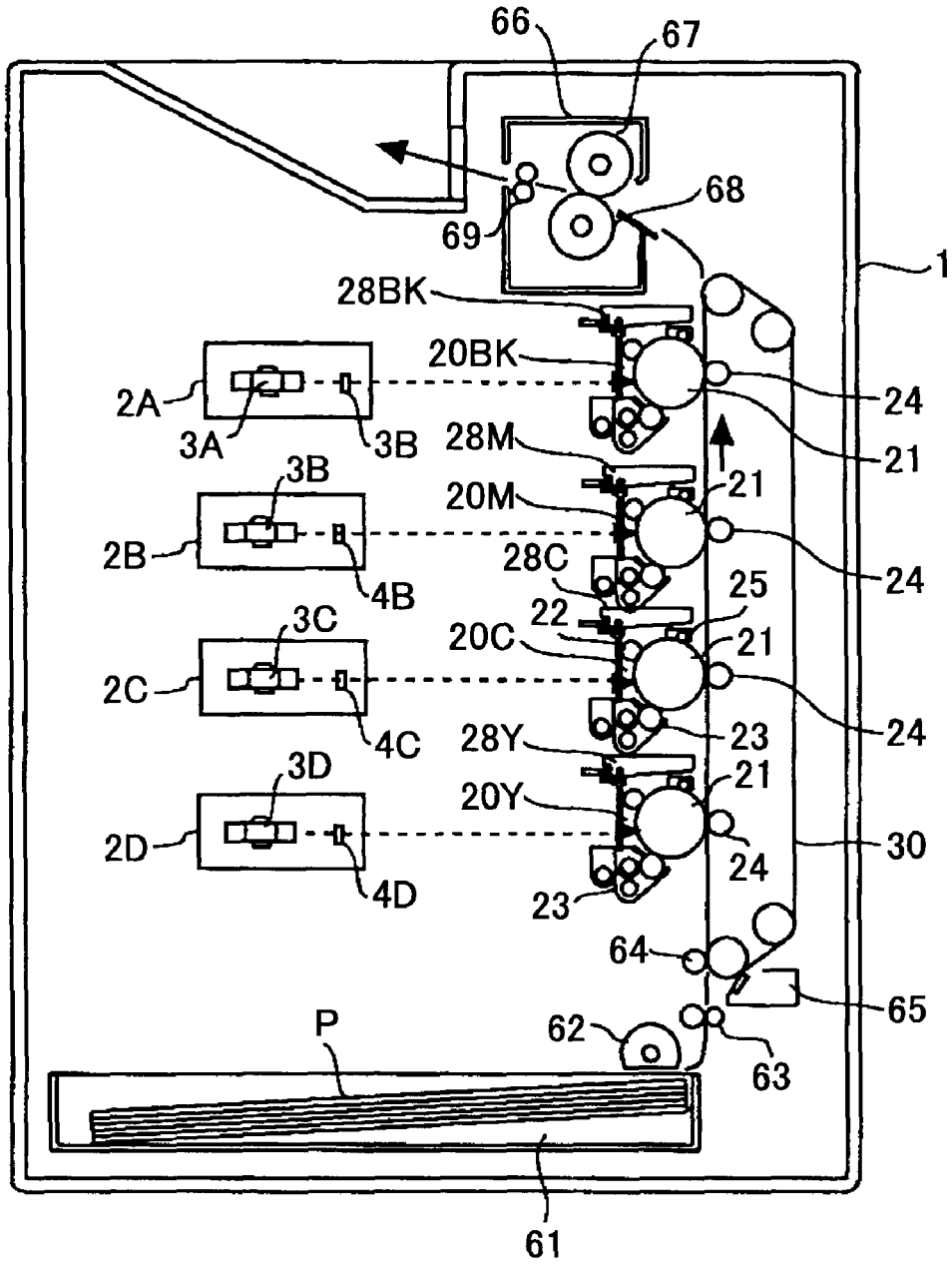
FIG. 1 is a diagram showing an image forming apparatus according to a first embodiment of the present invention.

A description is given below, with reference to the accompanying drawings, of embodiments of the present invention. In the drawings, the same or corresponding elements are referred to by the same reference numerals, and a redundant description thereof is suitably simplified or omitted.

First Embodiment

A description is given, with reference to FIG. 1 through FIG. 6, of a first embodiment of the present invention.

First, a description is given, with reference to FIG. 1, of an overall configuration and operation of an image forming apparatus according to the first embodiment of the present invention.

Writing parts 2A, 2B, 2C, and 2D are devices that write electrostatic latent images onto corresponding photosensitive body drums 21 (image carriers) after a charging process based on image information. The writing parts 2A through 2D are optical scanners using polygon mirrors 3A, 3B, 3C, and 3D and optical elements 4A, 4B, 4C, and 4D, respectively. Alternatively, the writing parts 2A through 2D may be LED arrays instead of optical scanners.

A paper feed part 61 contains transfer materials P such as OHP sheets and feeds the transfer materials P one by one to a transfer belt 30 at the time of forming an image.

The transfer belt 30, which is an endless belt for conveying the transfer material P by having the transfer material P electrostatically attracted and adhered to its surface so that toner images formed on the photosensitive body drums 21 are transferred onto the transfer material P, has an attraction and adhesion roller 64 and a belt cleaner 65 provided on its exterior surface.

Transfer rollers 24 opposite the corresponding photosensitive body drums 21 across the transfer belt 30 each have a cored bar coated with a conductive elastic layer. The conductive elastic layer of each transfer roller 24 is an elastic body whose electrical resistance (volume resistivity) is adjusted to medium resistance by mixing and dispersing a conductivity imparting agent such as carbon black, zinc oxide, or tin oxide in an elastic material such as polyurethane rubber or ethylene-propylene-diene polyethylene (EPDM).

A fixing part 66, which includes a heating roller 68 and a pressure roller 67, fixes a composite toner image on the transfer material P thereonto with pressure and heat.

Four process cartridges 20Y, 20C, 20M, and 20BK are provided longitudinally along the transfer belt 30 for forming yellow, cyan, magenta, and black toner images, respectively.

The process cartridges 20Y, 20C, 20M, and 20BK have respective agent cartridges 28Y, 28C, 28M, and 28BK provided thereon as supply parts that supply carriers (magnetic carriers) and color (yellow, cyan, magenta, and black) toners (toner particles) to corresponding developing units 23.

The process cartridges 20Y, 20C, 20M, and 20BK and the agent cartridges 28Y, 28C, 28M, and 28BK can be attached to and detached from an apparatus main body 1 by rotating the transfer belt 30 around a rotational support shaft so that the transfer belt 30 (unit) is open with respect to the process cartridges 20Y, 20C, 20M, and 20BK and the agent cartridges 28Y, 28C, 28M, and 28BK.

The image forming apparatus of this first embodiment is a multifunction type serving as a copier and a printer. When the image forming apparatus serves as a copier, image information read from a scanner is subjected to various kinds of image processing, such as A/D conversion, MTF correction, and tone processing, and is converted into writing data. When the image forming apparatus serves as a printer, image information of a page-description language or bitmap format transmitted from a computer is subjected to image processing and converted into writing data.

At the time of forming an image, the writing parts 2A through 2D emit exposure lights corresponding to image information items of black, magenta, cyan, and yellow onto the process cartridges 20BK, 20M, 20C, and 20Y, respectively. That is, the exposure lights (laser lights) from respective light sources are emitted onto the corresponding photosensitive body drums 21 through the polygon mirrors 3A through 3D and the optical elements 4A through 4D, respectively. As a result, toner images corresponding to the exposure lights are formed on the photosensitive body drums 21 (image carriers) of the process cartridges 20BK, 20M, 20C, and 20Y. These toner images are transferred onto the transfer material P.

The transfer material P fed from the paper feeding part 61 is conveyed to the position of the transfer belt 30 after being timed for the conveyance at the position of a registration roller 63. The attraction and adhesion roller 64 provided at the feed-in position of the transfer belt 30 causes the fed-in transfer material P to be attracted and adhered to the transfer belt 30 by applying voltage. The transfer material P, which moves as the transfer belt 30 runs in the direction indicated by an arrow in FIG. 1, successively passes the positions of the process cartridges 20Y, 20C, 20M, and 20BK, so that the toner images of respective colors are transferred onto the transfer material P in a superposed manner.

The transfer material P onto which the color toner images have been transferred is separated from the transfer belt 30 to reach the fixing part 66. The toner images on the transfer material P are heated while being held between the heating roller 68 and the pressure roller 67, so as to be fixed onto the transfer material P. On the other hand, the surface of the transfer belt 30 after separation of the transfer material P reaches the position of the belt cleaner 65, so as to be cleaned of dirt such as toner adhered thereto.

Next, a description is given in detail of the process cartridges 20Y, 20C, 20M, and 20BK and the agent cartridges 28Y, 28C, 28M, and 28BK.

The process cartridges 20Y, 20C, 20M, and 20BK have substantially the same structure, and the agent cartridges 28Y, 28C, 28M, and 28BK also have substantially the same structure. Accordingly, in FIG. 2, the process cartridge and the agent cartridge are referred to by reference numerals 20 and 28, respectively, without an alphabet letter (Y, C, M or BK). Likewise, the writing part is also referred to by reference numeral 2 without an alphabet letter (A, B, C or D).

Figure 2:
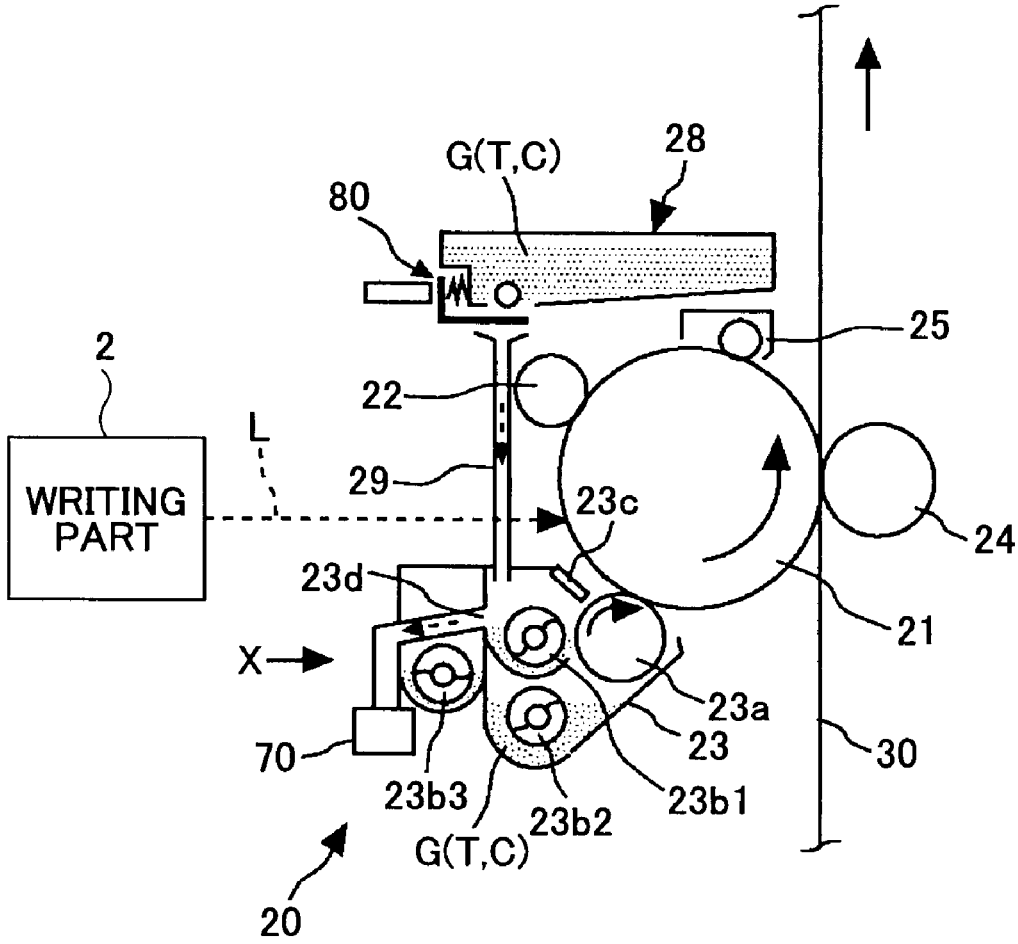
FIG. 2 is an enlarged view of a process cartridge provided in the image forming apparatus according to the first embodiment of the present invention.
Figure 3:
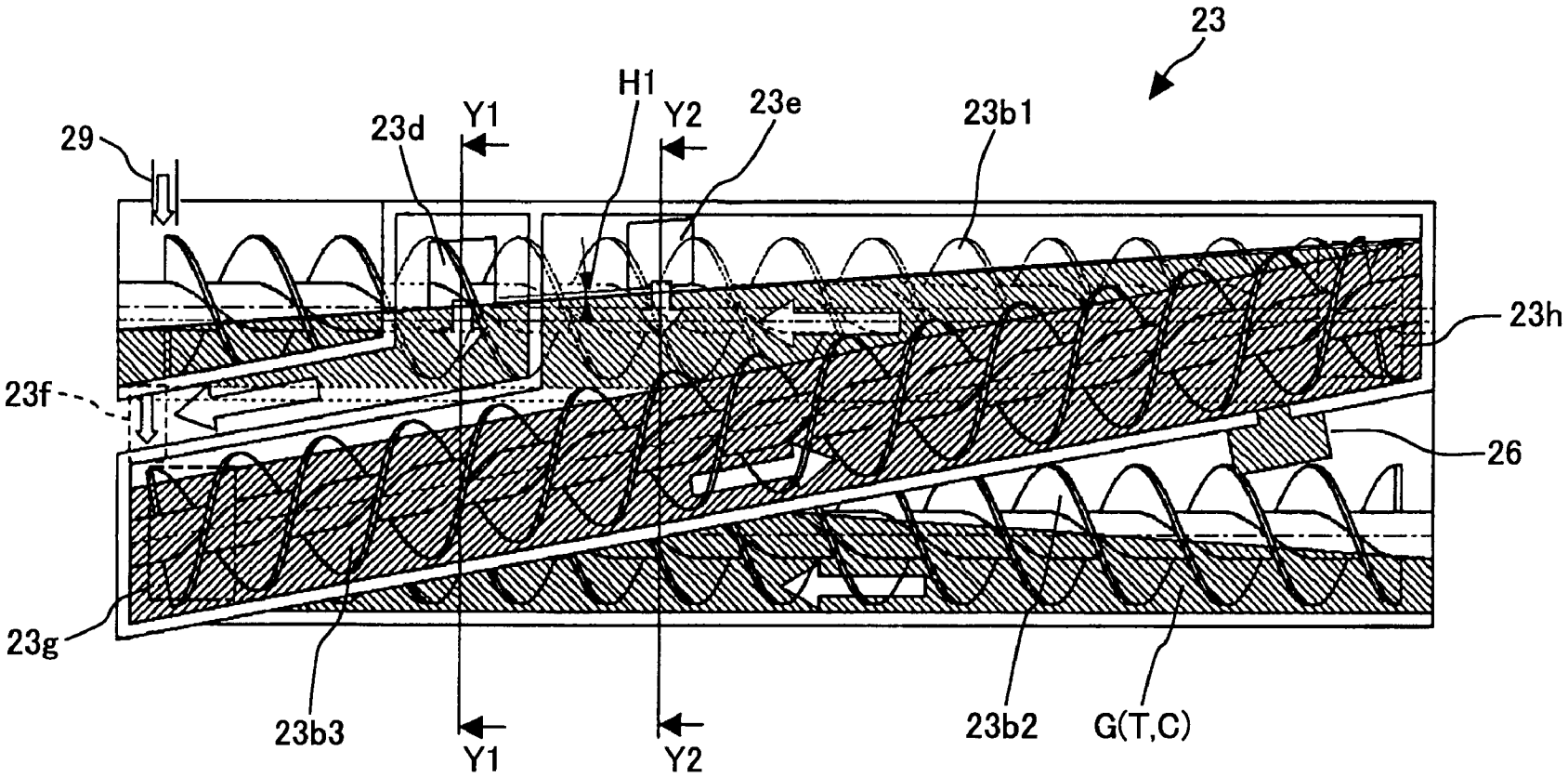
FIG. 3 is a longitudinal cut-away view of a circulation channel in a developing unit according to the first embodiment of the present invention.
Figure 4:
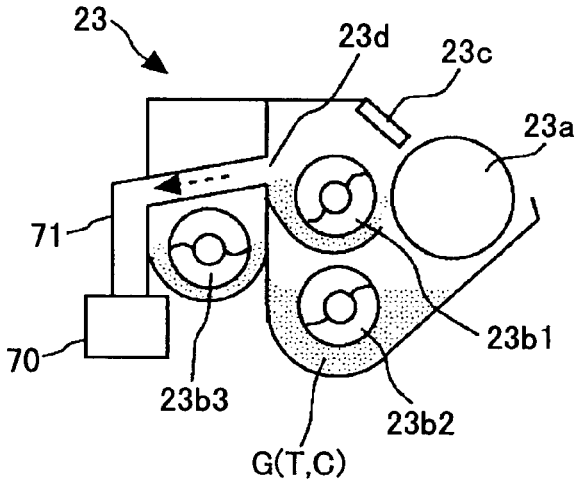
FIG. 4 is a cross-sectional view of the circulation channel of FIG. 3, taken along the line Y1-Y1 according to the first embodiment of the present invention.
Figure 5:
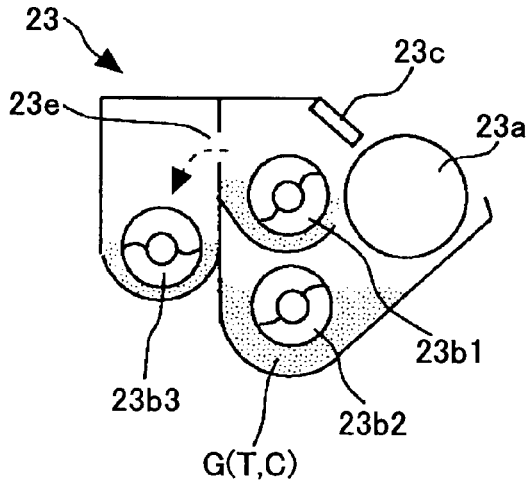
FIG. 5 is a cross-sectional view of the circulation channel of FIG. 3, taken along the line Y2-Y2 according to the first embodiment of the present invention.

FIG. 2 is an enlarged view of the process cartridge 20 and the corresponding agent cartridge 28 provided in the apparatus main body 1. FIG. 3 is a cut-away view from the direction of arrow X of a circulation channel in the corresponding developing unit 23, taken along a plane perpendicular to the direction of arrow X. FIG. 4 is a cross-sectional view of the circulation channel in the developing unit 23 of FIG. 3, taken along line Y1-Y1. FIG. 5 is a cross-sectional view of the circulation channel in the developing unit 23 of FIG. 3, taken along line Y2-Y2.

Here, according to the present invention, the term "process cartridge" is defined as a unit into which an image carrier and at least one of a charging part that charges the image carrier, a developing part (developing unit) that develops a latent image formed on the image carrier, and a cleaning part that cleans the surface of the image carrier are integrated, and which is provided removably (detachably and reattachably) with respect to the main body of an image forming apparatus.

Referring to FIG. 2, the photosensitive body drum 21 serving as an image carrier, a charging part 22, the developing unit 23 (developing part), and a cleaning part 25 are integrated into the process cartridge 20, which adopts the trickle development system.

The photosensitive drum body 21 as an image carrier, which is a negatively-charged organic photosensitive body, is rotated counterclockwise by a rotating mechanism (not graphically illustrated).

The charging part 22 is an elastic roller charging device having a roller-shaped medium-resistance urethane foam layer formed of polyurethane, carbon black as conductive particles, a sulfidizing agent, a foaming agent, etc., around a cored bar. Examples of the material of the medium resistance layer of the charging part 22 include a rubber material, which may be expanded, where a conductive material such as carbon black or metal oxide is dispersed for resistance adjustment in urethane, ethylene-propylene-diene polyethylene (EPDM), acrylonitrile-butadiene rubber (NBR), silicone rubber, or isoprene rubber.

The cleaning part 25, in which a cleaning brush (or cleaning blade) that comes into sliding contact with the photosensitive body drum 21 is provided, mechanically removes and collects untransferred toner on the photosensitive drum body 21.

The developing unit 23 has a developing roller 23*a* serving as a developer carrier placed in proximity to the photosensitive body drum 21, so that a development area where the photosensitive body drum 21 and a magnetic brush come into contact is formed where the developing roller 23*a* and the photosensitive body drum 21 face each other. The developing unit 23 contains developer G (two-component developer) formed of toner T and carrier C. The developing unit 23 develops an electrostatic latent image formed on the photosensitive body drum 21 (forms a toner image). A detailed description is given below of the configuration and operation of the developing unit 23.

Here, the developing unit 23 according to the first embodiment adopts the trickle development system, so that new carrier C (developer G) is suitably supplied into the developing unit 23 from the agent cartridge 28 and the degraded developer G is discharged to an agent reservoir 70 provided external to the developing unit 23.

Referring to FIG. 2, the agent cartridge 28 contains the developer G (toner T and carrier C) to be supplied into the developing unit 23. The agent cartridge 28 serves as a toner cartridge that supplies new toner T to the developing unit 23 and as a supply part that supplies new carrier C to the developing unit 23. Specifically, the agent cartridge 28 performs the opening and closing operations of a shutter mechanism 80 based on toner density information (the proportion of the toner T in the developer G) detected by a magnetic sensor 26 (FIG. 3) provided in the developing unit 23, so as to suitably supply the developer G into the developing unit 23 from the agent cartridge 28 as a supply part.

In this first embodiment, the mixture ratio of the toner T to the carrier C in the developer G of the agent cartridge 28 (toner density) is relatively high.

A supply pipe 29 serving as a supply part ensures introduction of the developer G (toner T and carrier C) supplied from the agent cartridge 28 into the developing unit 23. That is, the developer G discharged from the agent cartridge 28 is supplied into the developing unit 23 through the supply pipe 29.

Next, a description is given of an image forming process performed on the photosensitive body drum 21.

Referring to FIG. 2, when the photosensitive body drum 21 is rotated counterclockwise, first, the surface of the photosensitive body drum 21 is evenly charged at the position of the charging part 22. Thereafter, the charged surface of the photosensitive body drum 21 reaches the position of exposure to exposure light L, where an exposure process is performed by the writing part 2. That is, the surface of the photosensitive body drum 21 is selectively discharged in accordance with image information through exposure to the exposure light L, so as to generate a difference from the electric potential of a non-image part that has not been exposed (voltage contrast), thereby forming an electrostatic latent image. In this exposure process, a charge generation material receives light so as to generate an electric charge in the photosensitive layer of the photosensitive body drum 21, and generated holes counteract the electric charge on the charged surface of the photosensitive body drum 21.

Thereafter, the surface of the photosensitive body drum 21 on which the latent image is formed reaches a position opposite the developing unit 23. The electrostatic latent image on the photosensitive body drum 21 comes into contact with a magnetic brush on the developing roller 23*a*, so that the negatively charged toner T in the magnetic brush is adhered to the electrostatic latent image. As a result, the electrostatic latent image is visualized.

In detail, the developer G drawn up by the magnetic force of a magnetic pole of the developing roller 23*a* is adjusted to an appropriate amount by a doctor blade 23*c*, and is thereafter conveyed to the development area, where the developing roller 23*a* faces the photosensitive body drum 21. The carrier C comes into sliding contact with the photosensitive body drum 21 with chains or clusters of its particles in the development area. At this point, the toner T mixed in the carrier C is negatively charged through friction with the carrier C. On the other hand, the carrier C is positively charged. A predetermined development bias is applied to the developing roller 23*a* from a power supply part (not graphically illustrated). As a result, an electric field is formed between the developing roller 23*a* and the photosensitive drum 21 so as to cause the negatively charged toner T to be selectively adhered to only an image part on the photosensitive body drum 21, so that a toner image is formed.

Thereafter, the surface of the photosensitive body drum 21 on which the toner image is formed reaches a position where the transfer belt 30 and the transfer roller 24 face each other. Then, the toner image on the photosensitive body drum 21 is transferred onto the transfer material P that has been timed to be conveyed to the facing position for the transfer of the toner image. At this point, a predetermined voltage is applied to the transfer roller 24.

Thereafter, the transfer material P having the superposed toner images transferred thereonto passes through the fixing part 66 to be ejected outside the apparatus by an ejecting roller 69 (FIG. 1).

On the other hand, residual toner T on the photosensitive body drum 21, which has not been transferred onto the transfer material P at the time of the transfer process, or untransferred toner, remains adhered onto the photosensitive body drum 21 and reaches a part opposite the cleaning part 25. Then, the untransferred toner on the photosensitive body drum 21 is removed and collected in the cleaning part 25.

Thereafter, the surface of the photosensitive body drum 21 passes a discharge part (not graphically illustrated). Thereby, the image forming process on the photosensitive body drum 21 is completed.

A detailed description is given below of a configuration and operation of the developing unit 23 in the image forming apparatus according to this embodiment.

Referring to FIG. 2 through FIG. 5, the developing unit 23 includes the developing roller 23*a* as a developer carrier, first, second, and third conveyor screws 23*b*1, 23*b*2, and 23*b*3 (auger screws) as conveying members, and the doctor blade 23*c*.

The developing roller 23*a* is configured so that a cylinder-shaped sleeve of a non-magnetic material such as aluminum, brass, stainless steel, or conductive resin is rotated clockwise by a rotating mechanism (not graphically illustrated). In the sleeve of the developing roller 23*a*, a magnet is fixed that forms a magnetic field so as to cause clustering of the developer G on the surface of the sleeve. Chains (clusters) of particles of the carrier C in the developer G are formed to stand on the sleeve along magnetic lines of force in a normal direction emanated from the magnet. Particles of the charged toner T are adhered to these standing chains of particles of the carrier C so as to form a magnetic brush. The magnetic brush is conveyed in the same direction as the sleeve (clockwise) by the rotation of the sleeve.

The doctor blade 23*c* is provided on the upstream side of the development area so as to restrict the developer G on the developing roller 23*a* to an appropriate amount.

The three conveyor screws 23*b*1 through 23*b*3 agitate and mix the developer G contained in the developing unit 23 while circulating the developer G in a longitudinal direction (a direction perpendicular to the plane of the paper of FIG. 2).

The first conveyor screw 23*b*1 (first conveying member), which is provided at a position opposite the developing roller 23*a*, conveys the developer G in a horizontal direction (a leftward direction indicated by a white arrow in FIG. 3) and supplies the developer G onto the developing roller 23*a*.

The second conveyor screw 23*b*2 (second conveying member) is provided at a position below the first conveyor screw 23*b*1 and opposite the developing roller 23*a*. The second conveyor screw 23*b*2 conveys the developer G separated from the developing roller 23*a* (the developer G forcibly separated from the developing roller 23*a* by an agent separation pole after a development process) in a horizontal direction (a leftward direction indicated by a white arrow in FIG. 3). The first conveyor screw 23*b*1 and the second conveyor screw 23*b*2 are provided so as to have their axes of rotation substantially horizontal the same as the developing roller 23*a* and the photosensitive body drum 21.

The third conveyor screw 23*b*3 (third conveying member) is provided at an angle to a horizontal direction so as to linearly connect the downstream side of the channel of conveyance (conveyance channel) by the second conveyor screw 23*b*2 and the upstream side of the conveyance channel by the first conveyor screw 23*b*1. (See FIG. 3.) The third conveyor screw 23*b*3 conveys the developer G conveyed by the second conveyor screw 23*b*2 to the upstream side of the conveyance channel by the first conveyor screw 23*b*1, and conveys the developer G circulated from the downstream side of the conveyance channel by the first conveyor screw 23*b*1 through a falling channel 23*f* to the upstream side of the conveyance channel by the first conveyor screw 23*b*1 (diagonal conveyance to the upper right indicated by a white arrow in FIG. 3).

The conveyance channel by the first conveyor screw 23*b*1, the conveyance channel by the second conveyor screw 23*b*2, and the conveyance channel by the third conveyor screw 23*b*3 are separated from one another by wall parts.

Referring to FIG. 3, the downstream side of the conveyance channel by the second conveyor screw 23*b*2 and the upstream side of the conveyance channel by the third conveyor screw 23*b*3 communicate with each other through a first link part 23*g*. Further, the downstream side of the conveyance channel by the third conveyor screw 23*b*3 and the upstream side of the conveyance channel by the first conveyor screw 23*b*1 communicate with each other through a second link part 23*h*. Further, the downstream side of the conveyance channel by the first conveyor screw 23*b*1 and the upstream side of the conveyance channel by the third conveyor screw 23*b*3 communicate with each other through the falling channel 23*f*.

According to this configuration, the three conveyor screws 23*b*1 through 23*b*3 form a circulation channel that circulates the developer G in a longitudinal direction in the developing unit 23. Here, when the developing unit 23 is put into operation, the developer G contained in the developing unit 23 flows as indicated by oblique lines (hatching) in FIG. 3.

Referring to FIG. 3, the surface of the developer G is lower on the downstream side than on the upstream side in the conveyance channel by the first conveyor screw 23*b*1. This is because part of the developer G in conveyance is supplied to the developing roller 23*a*. That is, the developer G that is not supplied to the developing roller 23*a* moves to the upstream side of the third conveyor screw 23*b*3 through the falling channel 23*f*.

The magnetic sensor 26 serving as a toner density sensor is provided in the conveyance channel by the third conveyor screw 23*b*3. The developer G of a predetermined toner density is supplied from the agent cartridge 28 serving as a supply part into the developing unit 23 based on the information of toner density detected by the magnetic sensor 26.

Here, referring to FIG. 3 and FIG. 4, a discharge opening 23*d* serving as a discharge part through which part of the developer G contained in the developing unit 23 is discharged outside (to the agent reservoir 70) is provided in the conveyance channel by the first conveyor screw 23*b*1. In detail, the discharge opening 23*d* is for discharging a surplus of the developer G to the agent reservoir 70 when the (upper) surface of the developer G conveyed to the position of the discharge opening 23*d* exceeds a predetermined height because of an increase in the amount of the developer G in the developing unit 23 due to supply of the developer G from the agent cartridge 28 into the developing unit 23 through the supply pipe 29. That is, the surplus of the developer G exceeds the height (vertical dimension) of the lower part of the discharge opening 23*d* to be discharged from the discharge opening 23*d*, and gravitates toward the agent reservoir 70 via a discharge channel 71 (FIG. 4). Thus, the carrier C contaminated by the base resin or external additive of the toner T and degraded is automatically discharged outside the developing unit 23. Therefore, it is possible to suppress the degradation of image quality even over time.

Further, according to this first embodiment, in the circulation channel of the developer G in the developing unit 23, a bypass channel for causing part of the developer G to return to the upstream side of the circulation channel without passing the position where the above-described discharge opening 23*d* (discharge part) is provided. Specifically, referring to FIG. 3 and FIG. 5, an opening 23*e* is provided on the upstream side of the discharge opening 23*d* (at a position relatively close to the discharge opening 23*d*) in the conveyance channel by the first conveyor screw 23*b*1. This opening 23*e* serves as the entrance to the bypass channel, and the exit of the bypass channel is provided in (the vicinity of the center of) the conveyance channel by the second conveyor screw 23*b*3.

Thus, by providing a bypass channel in the circulation channel of the developer G in the developing unit 23, it is possible to prevent the problem of discharging a greater amount of the developer G than necessary from the developing unit 23 because of variations in the amount of the developer G discharged from the discharge opening 23*d* even when there is an undulatory inclination in the development G in the developing unit 23.

Figure 6:
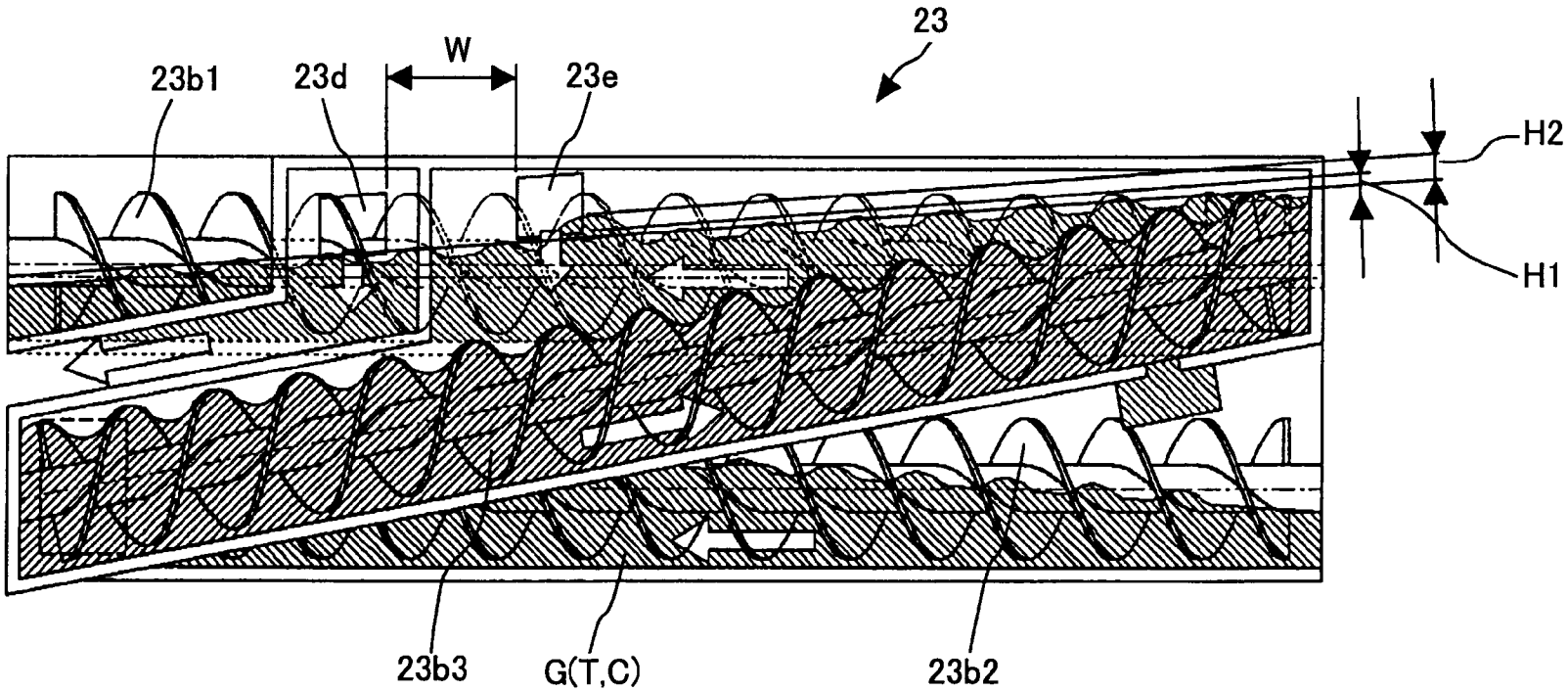
FIG. 6 is a diagram showing the circulation channel of FIG. 3, where there is an undulatory inclination in developer, according to the first embodiment of the present invention.

FIG. 6 is a diagram showing the circulation channel of the developer G in the developing unit 23, where there is an undulatory inclination in the developer G.

As shown in FIG. 6, there may be an undulatory inclination with large vertical variations in the circulation channel of the developer G. Such an undulatory inclination is most obvious immediately after the operation of the developing unit 23 is started (immediately after its restart). If such an undulatory inclination is caused, conventionally, all the developer G positioned higher than the lower part of the discharge opening 23*d* (part of the developer G corresponding to height H2 in FIG. 6) is discharged from the discharge opening 23*d*. Originally, it is not intended (planned) to discharge the developer G thus discharged. Therefore, repeated occurrence of such a phenomenon may cause a shortage of the developer G in the developing unit 23 so as to destabilize the degraded condition of the developer G or reduce the amount of electric charge of the toner T. As a result, a problem such as a decrease in image density may be caused in an output image.

On the other hand, according to this first embodiment, the opening 23*e* that communicates with a bypass channel is provided on the upstream side of the discharge opening 23*d*. Therefore, part of the developer G positioned higher than the lower part of the discharge opening 23*d* is returned to the conveyance channel in the third conveyor screw 23*b*3 through the opening 23*e* without being discharged from the discharge opening 23*d*. As a result, it is possible to prevent the problem of an excessive discharge of the developer G from the discharge opening 23*d*.

Here, according to this first embodiment, the lower part of the opening 23*e* in the bypass channel is positioned higher than the lower part of the discharge opening 23*d* by height H1.

As a result, of the developer G positioned higher than the lower part of the discharge opening 23*d*, a portion corresponding to the difference between H1 and H2 (H2−H1) is returned to the conveyance channel in the third conveyor screw 23*b*3 through the opening 23*e* without being discharged from the discharge opening 23*d*. As a result, it is possible to ensure prevention of the problem of an excessive discharge of the developer G from the discharge opening 23*d* while maintaining the original function of the discharge part.

Preferably, the longitudinal distance W between the discharge opening 23*d* and the opening 23*e* is as short as possible.

As described above, according to this first embodiment, there is provided a bypass channel (opening 23*e*) for causing part of the developer G to return to the upstream side of the circulation channel without passing the position where the discharge opening 23*d* (discharge part) is provided. Therefore, it is possible to provide the developing unit 23 of the trickle development system according to which no variation is caused in the amount of the developer G discharged to the agent reservoir 70 so that the quality of an output image is stabilized even if there is an undulatory inclination in the developer G in the developing unit 23.

According to this first embodiment, the present invention is applied to the developing unit 23 in which the three conveyor screws 23*b*1 through 23*b*3 serving as conveying members are provided. Alternatively, the present invention may also be applied to a developing unit in which two or more than three conveyor screws are provided. In this case also, the same effects as those of this first embodiment can be produced by providing a bypass channel for causing part of the developer to return to the upstream side of a circulation channel without passing the position where a discharge part is provided.

Further, according to this first embodiment, the third conveyor screw 23*b*3 is provided at an angle to a horizontal direction. Alternatively, the third conveyor screw 23*b*3 may also be provided horizontally.

Further, according to this first embodiment, the developer G (toner T and carrier C) is supplied from the agent cartridge 28 as a supply part to the developing unit 23. Alternatively, it is also possible to supply only the carrier C from the supply part to the developing unit 23. In this case, a toner cartridge that contains only toner is provided separately from the agent cartridge (carrier cartridge), and the toner contained in the toner cartridge is suitably supplied to the developing unit 23 based on the result of detection by the magnetic sensor 26.

Even in such a case, the same effects as those of this first embodiment can be produced.

Further, according to this first embodiment, the present invention is applied to the image forming apparatus where the process cartridge 20 forms part of the image forming part. However, the application of the present invention is not limited to this, and the present invention may also be applied to an image forming apparatus where the image forming part is not formed of a process cartridge. Specifically, the present invention may be applied to the case where the developing unit 23 is formed as a unit that can be independently attached to and detached from the image forming apparatus.

Second Embodiment

Figure 7:
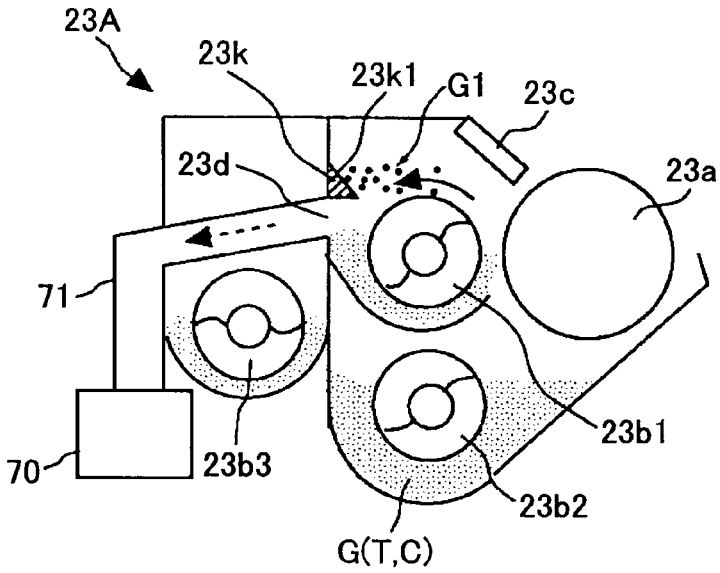
FIG. 7 is a cross-sectional view of a developing unit according to a second embodiment of the present invention.
Figure 8:
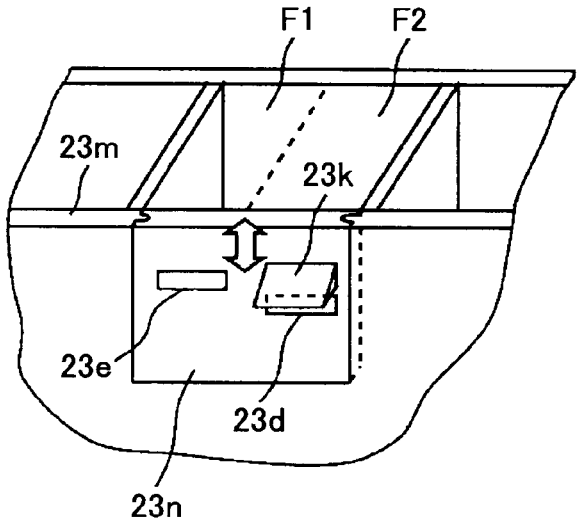
FIG. 8 is a perspective view of part of the developing unit according to the second embodiment of the present invention.
Figure 9:
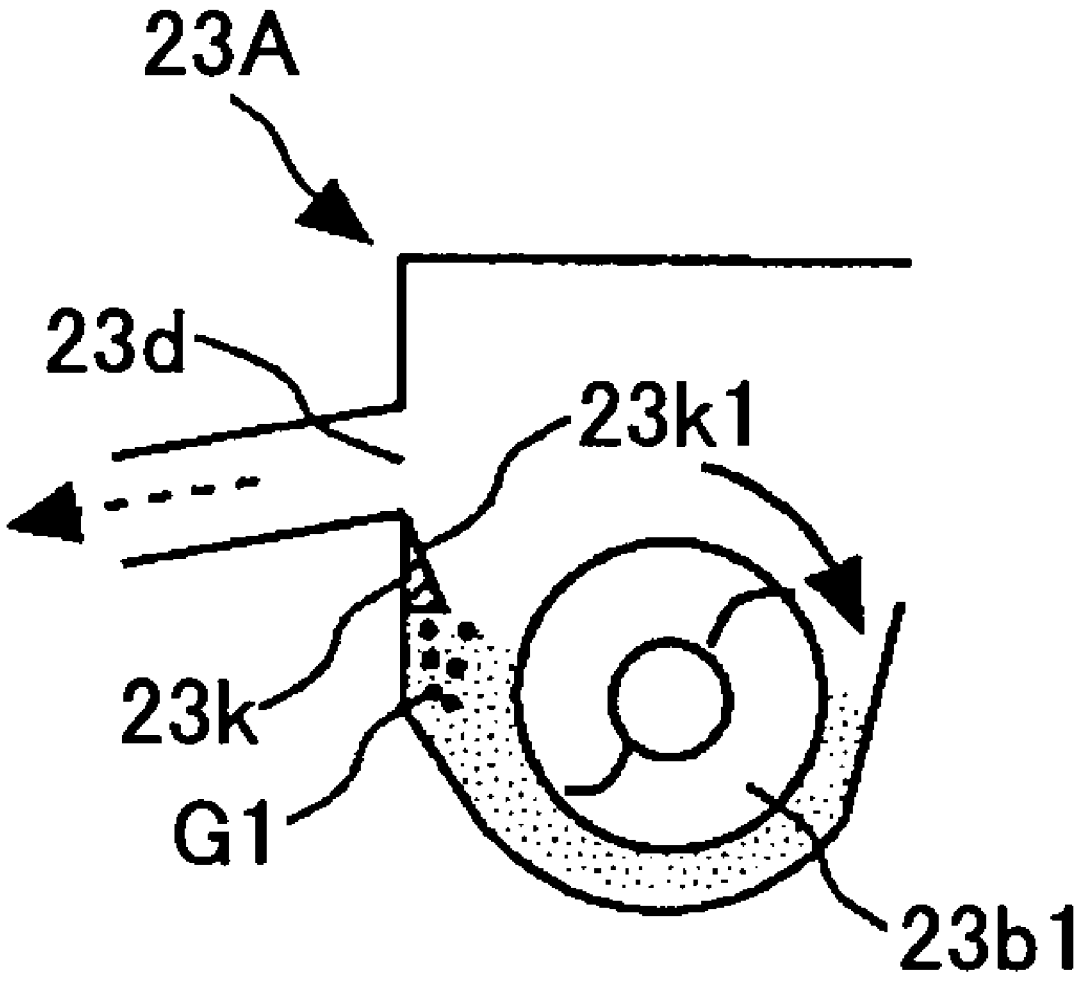
FIG. 9 is a cross-sectional view of a variation of the developing unit according to the second embodiment of the present invention.

A description is given, with reference to FIG. 7 through FIG. 9, of a second embodiment of the present invention.

FIG. 7 is a cross-sectional view of a developing unit 23A according to the second embodiment. FIG. 7 corresponds to FIG. 4 in the above-described first embodiment. One of the differences between the developing unit 23 of the first embodiment and the developing unit 23A of the second embodiment lies in that a projection part 23*k* is provided at the upper end of the discharge opening 23*d* in the developing unit 23A.

Like the developing unit 23 of the first embodiment, the developing unit 23A of this second embodiment also includes the discharge opening 23*d* as a discharge part and the opening 23*e* for returning part of the developer G to the conveyance channel by the third conveyor screw 23*b*3.

Here, according to the second embodiment, referring to FIG. 7, the projection part 23*k* (eaves) is provided at the upper end of the discharge opening 23*d*. This projection part 23*k* serves as a prevention member that prevents a developer G1 churned up by the first conveyor screw 23*b*1 rotating in the direction indicated by an arrow in FIG. 7 from entering the discharge opening 23*d*. That is, by providing the projection part 23*k* as a prevention member, it is possible to prevent the developer G1 thrown up by the first conveyor screw 23*b*1 from entering the discharge opening 23*d* and being collected and stored in the agent reservoir 70, so that it is possible to prevent a shortage of the developer G in the developing unit 23.

Thus, according to this second embodiment, the developer G1 churned up by the first conveyor screw 23*b*1 is returned to the conveyance channel by the first conveyor screw 23*b*1 after colliding with the projection part 23*k* without entering the discharge opening 23*d*. This allows the discharge opening 23*d* to satisfactorily fulfill its function as a discharge part without any side-effects.

According to this second embodiment, a slope (inclined plane) 23*k*1 is formed on the upper part of the projection part 23*k* as a prevention member so as to prevent a developer from being deposited thereon. This configuration causes the developer G1 colliding with the projection part 23*k* after being churned up by the first conveyor screw 23*b*1 to slide down along the slope 23*k*1 and return to the conveyance channel by the first conveyor screw 23*b*1 without being deposited on the projection part 23*k*. Accordingly, it is possible to prevent poor circulation of the developer G that may be caused by deposition of the developer G (G1) on the projection part 23*k*.

FIG. 8 is a perspective view of the vicinity of the discharge opening 23*d* and the opening 23*e*, taken from the side of the conveyance channel by the first conveyor screw 23*b*1.

Referring to FIG. 8, according to this second embodiment, the discharge opening 23*d* and the opening 23*e*, each of which may have a slit shape, are formed in a plate-shaped member 23*n* removably provided in the developing unit 23. In detail, the conveyance channel by the first conveyor screw 23*b*1 and the conveyance channel by the third conveyor screw 23*b*3 are separated by a wall part 23*m*. The plate-shaped member 23*n* is formed so as to be detachable from and attachable (reattachable) to this wall part 23 in the directions indicated by a double-headed white arrow in FIG. 8.

By thus forming or providing the plate-shaped member 23*n* having the discharge opening 23*d* and the opening 23*e* provided therein removably with respect to the developing unit 23, it is possible to change the height (vertical position) of each of the discharge opening 23*d* and the opening 23*e* with ease. That is, it is possible to change the height of each of the discharge opening 23*d* and the opening 23*e* merely by changing (replacing) the plate-shaped member 23*n* without changing (replacing) the entire developing unit 23.

This configuration is particularly useful in the case where it is desired to make the developing unit 23 common to two types of image forming apparatuses different in speed of conveying the transfer material P (process linear velocity). The rotational speeds of the conveyor screws 23*b*1 through 23*b*3 differ, and accordingly the form of the undulatory inclination of a developer differs, between developing units having different process linear velocities. Accordingly, even if the same developing unit is used, the appropriate positions of the discharge opening 23*d* and the opening 23*e* differ depending on the rotational speeds of the conveyor screws 23*b*1 through 23*b*3. According to this second embodiment, the plate-shaped members 23*n* that are different from each other in the heights (vertical positions) of the discharge opening 23*d* and the opening 23*e* are interchangeable with each other. This makes it possible to increase the commonality (compatibility) of the developing unit 23 between two types of image forming apparatuses having different process linear velocities.

As shown in FIG. 8, the wall face that separates a bypass channel F1 and a discharge channel F2 does not have to cover the entire boundary therebetween. Specifically, the wall face is not provided in the area where a developer discharged from the discharge opening 23*d* and a developer discharged from the opening 23*e* do not mix with each other because of their free fall.

Here, according to this second embodiment, the projection part 23*k* (eaves) as a prevention member is provided at the upper end of the discharge opening 23*d*. Alternatively, if the first conveyor screw 23*b*1 (conveying member) rotates in the direction indicated by an arrow (clockwise) as shown in FIG. 9, it is preferable to provide the projection part 23*k* (eaves) at the lower end of the discharge opening 23*d*. That is, it is preferable to provide the projection part 23*k* on the upstream side of the discharge opening 23*d* in the rotational direction of the first conveyor screw 23*b*1 facing the discharge opening 23*d*. This is because the developer G churned up by the first conveyor screw 23*b*1 moves so as to enter the discharge opening 23*d* from its lower side when the first conveyor screw 23*b*1 rotates in the direction shown in FIG. 9. Accordingly, by providing the projection part 23*k* at the lower end of the discharge opening 23*d*, it is possible to efficiently prevent the developer G churned up by the first conveyor screw 23*b*1 from entering the discharge opening 23*d*. Further, in this case also, it is possible to prevent the developer G (G1) from being deposited on the projection part 23*k* by forming the slope 23*k*1 on the upper part of the projection part 23*k*.

As described above, in this second embodiment as well as in the above-described first embodiment, there is provided a bypass channel (opening 23*e*) for causing part of the developer G to return to the upstream side of the circulation channel without passing the position where the discharge opening 23*d* (discharge part) is provided. Therefore, it is possible to provide the developing unit 23 of the trickle development system according to which no variation is caused in the amount of the developer G discharged to the agent reservoir 70 so that the quality of an output image is stabilized even if there is an undulatory inclination in the developer G in the developing unit 23.

The present invention is not limited to the specifically disclosed embodiments, and variations and modifications may be made without departing from the scope of the present invention. The number, positions, or shapes of the above-described components (elements) are not limited to those of the above-described embodiments, and may be determined so as to be suitable for implementing the present invention.

The present application is based on Japanese Patent Applications No. 2006-063645, filed on Mar. 9, 2006, and No. 2007-036928, filed on Feb. 16, 2007, the entire contents of which are hereby incorporated by reference.

What is claimed is:

1. A developing unit containing a developer including a carrier and a toner, and developing a latent image formed on an image carrier, the developing unit comprising:

a plurality of conveyor members configured to convey the contained developer in respective longitudinal directions so as to form a circulation channel;

a supply part configured to supplement the carrier in the developing unit;

a discharge part configured to discharge a first part of the contained developer to outside of the developing unit; and a bypass channel configured to cause a second part of the developer to return to an upstream side of the circulation channel without passing a position where the discharge part is provided, wherein:

the discharge part includes a discharge opening for discharging the first part of the developer in response to a surface of the developer conveyed to a position of the discharge opening exceeding a predetermined first height;

the bypass channel includes an opening for guiding the second part of the developer to the bypass channel in response to the surface of the developer conveyed to a position of the opening exceeding a predetermined second height;

the opening is provided on an upstream side of the discharge opening in the circulation channel; and a lower part of the opening is positioned higher than a lower part of the discharge opening.

2. The developing unit as claimed in claim 1, further comprising:

a prevention member configured to control entrance of the developer into the discharge opening.

3. The developing unit as claimed in claim 2, wherein the prevention member comprises a projection part provided at one of an upper end and a lower end of the discharge opening.

4. The developing unit as claimed in claim 3, wherein the projection part comprises a slope so as to prevent the developer from being deposited thereon.

5. The developing unit as claimed in claim 1, wherein the discharge opening and the opening comprise respective slits formed in a plate-shaped member provided removably with respect to the developing unit.

6. A developing unit containing a developer including a carrier and a toner, and developing a latent image formed on an image carrier, the developing unit comprising:

a plurality of conveyor members configured to convey the contained developer in respective longitudinal directions so as to form a circulation channel;

a supply part configured to supplement the carrier in the developing unit;

a discharge part configured to discharge a first part of the contained developer to outside of the developing unit;

a bypass channel configured to cause a second part of the developer to return to an upstream side of the circulation channel without passing a position where the discharge part is provided;

a developer carrier facing the image carrier and configured to carry the developer; and a wall part, wherein:

the conveying members comprise a first conveying member facing the developer carrier and configured to supply the developer to the developer carrier, a second conveying member provided at a position below the first conveying member and opposite the developer carrier and configured to convey the developer separated from the developer carrier, and a third conveying member configured to convey the developer conveyed by the second conveying member to an upstream side of a first conveyance channel by the first conveying member;

the wall part is configured to separate the first conveyance channel by the first conveying member, a second conveyance channel by the second conveying member, and a third conveyance channel by third conveying member from one another;

the discharge part includes a discharge opening for discharging the first part of the developer in response to a surface of the developer conveyed to a position of the discharge opening exceeding a predetermined first height;

the bypass channel includes an opening for guiding the second part of the developer to the bypass channel in response to the surface of the developer conveyed to a position of the opening exceeding a predetermined second height;

the opening is provided on an upstream side of the discharge opening in the circulation channel;

a lower part of the opening is positioned higher than a lower part of the discharge opening; and the discharge opening and the opening comprise respective slits formed in a plate-shaped member removably provided in the wall part.

7. The developing unit as claimed in claim 6, wherein:

the third conveying member is configured to convey the developer reaching a downstream side of the first conveyance channel by the first conveying member to the upstream side of the first conveyance channel by the first conveying member;

the discharge part is provided in the first conveyance channel by the first conveying member; and the bypass channel is provided so as to link a position on an upstream side of the discharge part in the first conveyance channel by the first conveying member and a position in the third conveyance channel by the third conveying member.

8. The developing unit as claimed in claim 6, further comprising:

a projection part provided at an upper end of the discharge opening.

9. The developing unit as claimed in claim 8, wherein the projection part comprises a slope so as to prevent the developer from being deposited thereon.

10. The developing unit as claimed in claim 1, wherein the supply part is configured to supplement the toner along with the carrier in the developing unit.

11. A process cartridge removably provided in a main body of an image forming apparatus, the process cartridge comprising:

the developing unit and the image carrier as set forth in claim 1 integrated as a unit.

12. An image forming apparatus, comprising:

the developing unit and the image carrier as set forth in claim 1.

13. A developing unit containing a developer including a carrier and a toner, and developing a latent image formed on an image carrier, the developing unit comprising:

a plurality of conveyor members configured to convey the contained developer in respective longitudinal directions so as to form a circulation channel;

a supply part configured to supplement the carrier in the developing unit;

a discharge part configured to discharge a part of the contained developer to outside of the developing unit; and a projection part configured to control entrance of the developer into the discharge part, the projection part being provided at one of an upper end and a lower end of the discharge part, wherein the discharge part comprises a slit formed in a plate-shaped member provided removably with respect to the developing unit.

14. The developing unit as claimed in claim 13, wherein the projection part is provided on an upstream side of the discharge part in a rotational direction of one of the conveying members facing the discharge part.

15. The developing unit as claimed in claim 13, wherein the projection part comprises a slope so as to prevent the developer from being deposited thereon.

16. The developing unit as claimed in claim 13, wherein the supply part is configured to supplement the toner along with the carrier in the developing unit.

17. A process cartridge removably provided in a main body of an image forming apparatus, the process cartridge comprising:

the developing unit and the image carrier as set forth in claim 13 integrated as a unit.

18. An image forming apparatus, comprising:

the developing unit and the image carrier as set forth in claim 13.

19. The developing unit as claimed in claim 6, wherein the supply part is configured to supplement the toner along with the carrier in the developing unit.

20. A process cartridge removably provided in a main body of an image forming apparatus, the process cartridge comprising:

the developing unit and the image carrier as set forth in claim 6 integrated as a unit.

21. An image forming apparatus, comprising:

the developing unit and the image carrier as set forth in claim 6.

* * * * *